US005614288A

United States Patent [19]

Bustos

[11] Patent Number: 5,614,288

[45] Date of Patent: Mar. 25, 1997

[54] CO-EXTRUDED PLASTIC SLIP SURFACE

[75] Inventor: Rafael T. Bustos, Alpharetta, Ga.

[73] Assignee: L&P Property Managemet Company, Chicago, Ill.

[21] Appl. No.: 429,867

[22] Filed: Apr. 27, 1995

[51] Int. Cl.[6] ..... B32B 3/28; A47F 1/04

[52] U.S. Cl. ..... 428/167; 428/212; 211/59.2

[58] Field of Search ..... 428/156, 167, 428/119, 120, 149, 212, 447, 451; 211/59.2, 72

[56] References Cited

U.S. PATENT DOCUMENTS

| | | | |
|---|---|---|---|
| 2,218,444 | 10/1940 | Vineyard | 211/49 D |
| 4,314,648 | 2/1982 | Spamer | 211/49 D |
| 4,416,380 | 11/1983 | Flum | 211/49 D |
| 4,454,949 | 6/1984 | Flum | 211/49 D |
| 4,461,388 | 7/1984 | Bustos | 211/49 D |
| 4,470,943 | 9/1984 | Preis | 264/162 |
| 4,488,918 | 12/1984 | Jofs | 428/172 |
| 4,565,725 | 1/1986 | Spamer | 428/167 |
| 4,598,828 | 7/1986 | Young et al. | 211/59.2 |
| 4,651,883 | 3/1987 | Gullett et al. | 211/59.2 |
| 4,809,855 | 3/1989 | Bustos | 211/59.2 |
| 4,816,316 | 3/1989 | Robbins | 428/161 |
| 5,076,443 | 12/1991 | Trulaske, Sr. | 211/49 D |
| 5,197,610 | 3/1993 | Bustos | 211/59.2 |

*Primary Examiner*—Donald Loney
*Attorney, Agent, or Firm*—Wood, Herron & Evans, P.L.L.

[57] ABSTRACT

A low friction slip surface track for a merchandizing display rack including an extruded plastic base plate and a plurality of co-extruded plastic beads. The beads are formed of a compounded plastic, a mixture of high impact styrene and a percentage of silicone varying from 0.5 percent (0.5%) to 10 percent (10%). The base plate is formed of pure high impact styrene. The silicone in the beads makes the beads of lower surface friction than the base plate, facilitating the transfer of product down the track. The beads are formed of a light color plastic. The base plate is formed of a dark plastic to hide dirt while still creating an attractive merchandizing track and rack employing the track.

12 Claims, 1 Drawing Sheet

CO-EXTRUDED PLASTIC SLIP SURFACE

FIELD OF THE INVENTION

This invention relates to a co-extruded plastic slip surface commonly used in merchandising display units.

BACKGROUND OF THE INVENTION

Merchants commonly display their products in shelved structures. In order to provide product et the front of the shelves, the shelves are commonly sloped downwardly so that gravity forces the product to the forward edge of the shelves where it is easily accessible to consumers. The angle of the shelf determines the amount of force gravity will have on the product so that the product moves forward.

Such inclined shelves have been manufactured with tracks or channels parallel to the longitudinally extending portion of the shelves so that the product is displayed in orderly rows. Arranging the products in rows enables the merchant to display different products without products getting mixed up. However, forming channels in the metal shelves is got an economical method of manufacturing the shelves.

A much more economical way of manufacturing shelves having gravity feed channels is to construct a gravity feed track of plastic for insertion inside a flat metal shelf. Many patents disclose a plastic gravity feed track which is inserted into a shelf of a display rack. Each of these track members includes a substantially flat base portion with a plurality of spaced longitudinally extending ribs or runners which project upwardly from the base portion. Channels or grooves are formed between the ribs or runners to receive and hold a product, such as bottled drinks.

The track members are typically of unitary construction, commonly made of extruded or molded plastic. Typical plastics used are high impact polystyrene, polycarbonates, various nylons, or rigid vinyl compositions.

In the case of slip surface members of extruded plastic, the plastic is conventionally impregnated with silicone in order to increase the slipperiness of the plastic so that products may slide more easily down the slip surface member to the front of the dispensing tray. The silicone acts to decrease the coefficient of friction between the slip surface member and the product resting atop the slip surface member. As disclosed in U.S. Pat. Nos. 4,454,949, and 4,416,380, for example, the percentage of silicone typically varies between 0.5 percent (0.5%) and 5 percent (5%).

There have in the past been numerous attempts to reduce the cost of silicone containing low friction slide or slip surface tracks while maintaining a relatively high content of silicone so as to maintain the slipperiness of the track. One such attempt is described in U.S. Pat. No. 4,416,380 which discloses in one embodiment an extruded plastic slip surface including a substantially flat base portion having a series of upstanding ribs. According to the disclosure of the patent, the ribs or runners may be impregnated with about 0.5 percent (0.5%) to 5 percent (5%) silicone to improve slidability and aid in guiding products during their downward movement.

Another U.S. Pat. No. 41565,725, discloses a method of forming a composite track using co-extrusion. According to the disclosure of the patent, high impact polystyrene is extruded simultaneously with a mixture of high impact polystyrene and organopolysiloxane. A thin slide plate made up of a mixture of high impact polystyrene and organopolysiloxane is bonded to a thicker base plane composed of pure high impact polystyrene. Since organopolysiloxane is relatively expensive compared to polystyrene, the resulting co-extruded product is less expensive than a slide plate made completely of a mixture of polystyrene and organopolysiloxane.

While the patents described hereinabove have disclosed techniques for reducing the costs of low friction slide tracks, the resulting tracks are still relatively expensive. Additionally, the tracks described in these patents still are subject to a common problem encountered with all slide tracks. That is, all slide tracks while in use collect dust and dirt and, over time, lose some of their slipperiness and become unattractive as merchandising displays.

It has, therefore, been one objective of this invention to provide a low friction slip surface track which is less expensive to manufacture than prior art tracks, but which is just as effective and slippery as a slide surface.

It has been a further objective of this invention to provide a low friction slip surface track which is more attractive as a merchandising display track than prior tracks and which, in use, hides or disguises dirt collecting in the top surface of the track.

It has been a further objective of this invention to provide a low friction slip surface track composed of an extruded, dark-colored plastic base plate and a plurality of co-extruded ribs or beads of a light color such that the colors correspond to the brand name colors of merchandise displayed atop the tray.

SUMMARY OF THE INVENTION

The invention of the application which accomplishes these objectives comprises a low friction slip surface track for a merchandising rack, which includes an extruded longitudinally extending plastic base plate and a plurality of co-extruded spaced longitudinally extending plastic beads bonded to the top surface of the base plate. The beads contain from 0.5 percent (0.5%) to 10 percent (10%) of silicone in order to lower the coefficient of friction relative to that of the base plate. In order to hide or disguise dirt on the surface of the track while maintaining an attractive merchandising surface, the base plate portion of the track is formed of a dark color plastic and the co-extruded beads are formed of a light colored plastic. The resulting product is attractive in appearance and has another advantage in that the dark and light colors selected for the base and bead portion of the track may be selected so as to match the brand colors of the products displayed atop the slip surface.

The base plate, formed of a, plastic material such as polystyrene, contains no silicone, and constitutes the major portion of the slip surface while the silicone containing beads constitute a very small portion or percentage of the overall track. This configuration lowers the production cost of the slip surface track. This and other objects and advantages of the invention will be more apparent from the following description of the drawings.

DETAILED DESCRIPTION OF THE INVENTION

Figure 1:
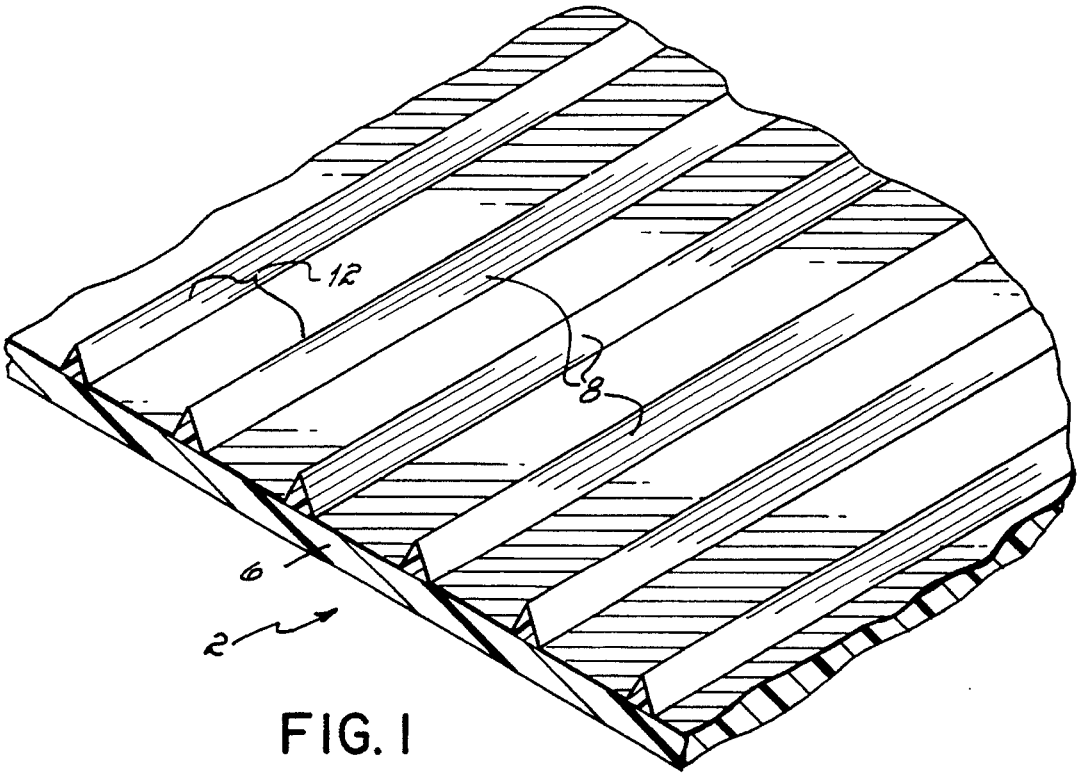
FIG. 1 is a perspective view of the slip surface track incorporating the invention of the application.

Referring to the drawings, there is illustrated in FIG. 1 a slip surface track 2 for a merchandising display rack. The slip surface track 2 may be inserted into a tray 4 of a merchandising display rack (not shown), as for example, the display rack of assignee's own U.S. Pat. No. 4,461,388, the disclosure of which is hereby incorporated by reference for disclosure purposes.

The slip surface track 2 consists of an extruded longitudinally extending plastic base plate 6 and a plurality of co-extruded spaced longitudinally extending plastic beads 8. The base plate preferably comprises a high impact polystyrene, but could as well be any other inexpensive extrudable plastic material. The beads are all of identical composition, and preferably comprises a mixture of polystyrene and from 0.5 percent (0.5%) to 10 percent (10%) silicone. The mixture of plastic and silicone has a lower coefficient of friction than pure plastic polystyrene. Therefore, the beads 8 have a lower coefficient of friction than the pure plastic polystyrene base 6, enabling displayed items to travel or slide down the tray 4, which is typically inclined.

The plurality of beads 8 form a plurality of channels 12, one channel defined by two adjacent beads. The channels 12 may receive portions of the products to be displayed, as for example, lobes on the bottom of displayed beverage bottles. The channels 12 are defined between the beads, and therefore, run longitudinally, parallel to beads 8. The width of channels 12 is defined by the distance between beads 8. This width may vary depending on the product to be displayed, but typically are spaced apart approximately five millimeters. Typically, the beads are approximately one millimeter in height.

One key aspect of this invention is that the beads 8 are co-extruded and thereby directly bonded to base plate 6. The temperatures and pressures in the exit of the extruder are such that the beads 8 are directly bonded onto the base plate 6 during the extrusion process, although the beads 8 are of different composite plastic material than the base plate 6.

Because the compounded styrene containing silicone of which the beads 8 are formed is more expensive that the pure high impact styrene used to make the base and because the beads represent such a small percentage of the overall track, the total cost of producing the slip surface track is substantially lower than if the entire width track were made of compounded styrene containing silicone.

Figure 2:
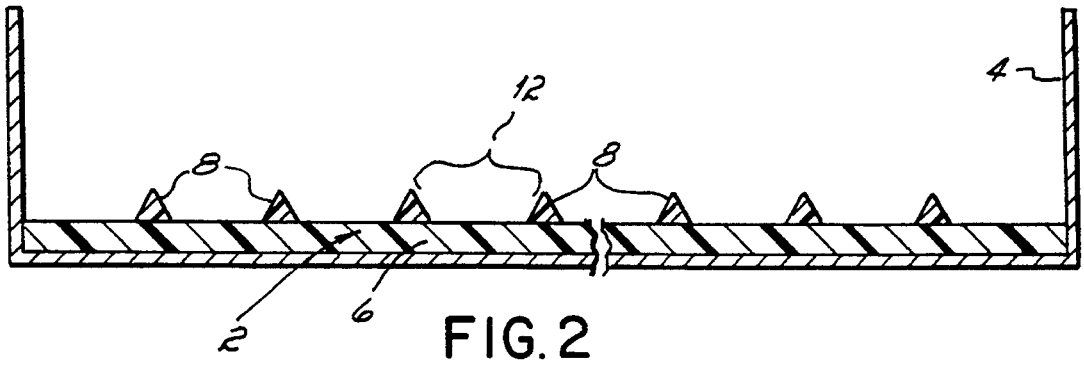
FIG. 2 is a cross-sectional view of the slip surface track of FIG. 1.
Figure 3:
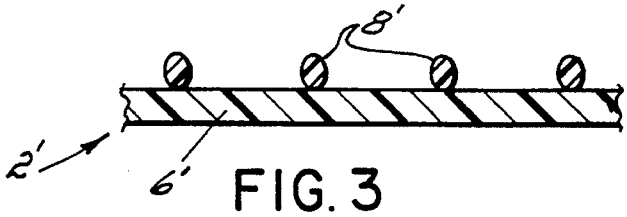
FIG. 3 is a cross-sectional view of a second preferred embodiment of the invention.

With reference now to FIG. 3, there is illustrated a second embodiment of the invention of this application. In this embodiment, those components of the inventive slip surface track which are substantially identical to the corresponding components of the embodiment of FIGS. 1 and 2 have been given the same numerical designation followed by a prime (') mark.

In this embodiment, the ribs or beads 8' are generally oval-shaped rather than being triangular-shaped. In all other respects, this embodiment is identical to the embodiment of FIG. 2. Because the beads, though, are generally oval in shape rather than triangular, they are, in some instances, and with some plastic compositions, easier to co-extrude onto the base portion or base plate 6' of the track 2'.

According to the practice of this invention, the base portion or base plate of the co-extruded track 2, 2' is compounded with a dark coloring agent while the silicone-containing plastic ribs 8, 8' are compounded of a light colored plastic. In one preferred embodiment, the base plate portion of the co-extruded track 2, 2' is colored red and in another embodiment, colored dark blue. In both embodiments, the beads 8, 8' were compounded of a very white styrene plastic. As a result of these different colors, the resulting track is very decorative and attractive as a portion of a merchandising rack. Additionally, the dark color base has the advantage of hiding or disguising dirt which may accumulate on the top surface of the track and render the track less attractive as well as reducing the slipperiness of the top surface.

It has also been found to be desirable to match the differing colors of the track to the brand of product being merchandised atop the track. In one preferred embodiment, and in order to match one customer's brand colors, the colors selected were red for the base plate and white for the ribs or beads, while for merchandising another customer's products, the base plate 6, 6' and ribs 8, 8' were selected as dark blue and white, respectively, While I have described two preferred embodiments of my invention, I do not intend to be limited except by the scope of the following claims.

What is claimed is:

1. A low friction slip surface for insertion into a tray of a merchandising display rack comprising: an extruded longitudinally extending plastic base plate and a plurality of individual co-extruded spaced, longitudinally extending plastic beads bonded directly to the top surface of said base plate, said beads each containing from 0.5 percent (0.5%) to ten percent (10%) of silicone to render said beads of a lower surface friction than said base plate, said base plate being formed from a first color plastic and said beads being formed of a second color plastic.

2. The low friction slip surface of claim 1 wherein said beads are of triangular cross section.

3. The low friction slip surface of claim 1 wherein said beads are of oval cross section.

4. The low friction slip surface of claim 1 wherein said base plate is made of high impact polystyrene.

5. The low friction slip surface of claim 1 wherein said beads are made of a mixture of polystyrene and silicone.

6. The low friction slip surface of claim 1 wherein said beads are approximately one millimeter in height and are spaced approximately five millimeters.

7. A tray for a merchandising display rack comprising a floor and two side walls extending upwardly from opposite side edges of the floor, said tray containing a low friction slip surface track, said slip surface track comprising: an extruded longitudinally extending plastic base plate and a plurality of individual co-extruded spaced, longitudinally extending plastic beads bonded directly to the top surface of said base plate, said beads each containing from 0.5 percent (0.5%) to 10 percent (10%) of silicone to render said beads of lower surface friction than said base plate, said base plate being formed from a first color plastic and said beads being formed of a second color plastic.

8. The tray of claim 7 wherein said beads are of a triangular cross section.

9. The tray of claim 7 wherein said beads of an oval cross section.

10. The tray of claim 7 wherein said base plate is made of high impact polystyrene.

11. The tray of claim 7 wherein said beads are made of a mixture of polystyrene and silicone.

12. The tray of claim 7 wherein said beads are approximately one millimeter in height and are spaced approximately five millimeters.

* * * * *